US005114359A

United States Patent [19]

Chishima et al.

[11] Patent Number: 5,114,359

[45] Date of Patent: May 19, 1992

[54] CONNECTOR

[75] Inventors: Masamitsu Chishima, Suzuka; Takao Nozaki, Tsu, both of Japan

[73] Assignee: Sumitomo Wiring Systems Ltd., Mie, Japan

[21] Appl. No.: 717,154

[22] Filed: Jun. 18, 1991

[30] Foreign Application Priority Data

Jul. 13, 1990 [JP] Japan ..... 2-186573
Jul. 13, 1990 [JP] Japan ..... 2-186574

[51] Int. Cl.[5] ..... H01R 13/00
[52] U.S. Cl. ..... 439/271; 439/489
[58] Field of Search ..... 439/271-277, 439/488-491

[56] References Cited

U.S. PATENT DOCUMENTS

| | | | |
|---|---|---|---|
| 3,414,806 | 12/1968 | Carr | 439/489 |
| 3,771,098 | 11/1973 | Dempsey | 439/489 |
| 4,917,620 | 4/1990 | Samejima et al. | 439/271 |
| 4,932,875 | 6/1990 | Ogawa et al. | 439/271 |

*Primary Examiner*—Joseph H. McGlynn
*Attorney, Agent, or Firm*—Sughrue, Mion, Zinn, Macpeak & Seas

[57] ABSTRACT

The disclosure is directed to a connector having a waterproof capacity in which male and female connector housings are easily coupled with each other for complete fitting, while the state of the fitting may be readily ensured at high reliability, with substantial elimination of disadvantages inherent in the conventional connectors of this kind.

4 Claims, 5 Drawing Sheets

CONNECTOR

BACKGROUND OF THE INVENTION

The present invention generally relates to a connector including a male connector housing and a female connector housing to be coupled with each other, and more particularly, to a waterproof or watertight connector provided with a seal ring at a fitting portion between the male and female connector housings. The present invention also relates to a coupling ensuring means for ensuring whether or not a coupling attitude of the set of connector housings fitted to each other is normal.

Conventionally, for example, in a waterproof connector arranged to achieve resistance against water by fitting an end portion of a female connector housing with a forward end half portion of a male connector housing, thereby to provide a waterproof capacity at said fitted portion, it has been a common practice to dispose a seal ring at such fitted portion where the set of connector housings are coupled with each other.

Meanwhile, when the set of connector housings are fitted with each other for coupling, there may be a case where such connector housings are not normally coupled due to insufficient amount of fitting therebetween, thus undesirably resulting in a half or insufficiently fitted connector. Accordingly, there has been conventionally proposed an arrangement in which a detection spacer disclosed, for example, in Japanese Patent Laid-Open Publication Tokkaisho No. 62-160674 is employed as means for ensuring whether or not the coupling between the connector housings is normal, whereby upon correct fitting between the connector housings, said detection spacer becomes slidable to reveal a detecting portion, and through a visual observation of said detecting portion, the state of coupling can be ensured.

In the known waterproof connector as referred to above, however, during fitting between the male and female connector housings, since inner and outer faces of the seal ring are held under pressure contact with the sides of the male and female connector housings, resistance during the fitting tends to be large and there are cases where faulty coupled connectors are formed due to incomplete half-fitting between the end portions of the connector housing, resulting from a slight insufficiency in the amount of fitting.

Meanwhile, in the conventional practice, since the confirmation as to whether the state of fitting is complete or not relies on feeling in the manual fitting work and visual judgement, reliability of the confirmation is low, and the faulty insufficiently fitted state has been overlooked in some cases. Moreover, in the prior art arrangement referred to above, since the confirmation is mainly based on the visual observation to see if the detecting portion has appeared on the main body of the connector housing, there are various disadvantages as follows.

For example, since the connector for an automobile wire harness is connected in a small space of a car body in many cases, it can not be used depending on conditions due to absence of a visual field for confirming the state of fitting of the connector housing main body. Moreover, in order to make the visual confirmation accurate, it is required to adopt an attitude or posture of the connector to facilitate observation of the detecting portion, thus resulting in inconvenience on the part of a worker. Furthermore, such a connector can not be used as a waterproof connector to be attached with a seal ring due to its structure.

SUMMARY OF THE INVENTION

Accordingly, an essential object of the present invention is to provide a connector having a waterproof capacity in which male and female connector housings are easily coupled with each other for complete fitting therebetween, while the state of the fitting may be readily ensured at high reliability, with substantial elimination of disadvantages inherent in the conventional connectors of this kind.

Another object of the present invention is to provide a connector of the above described type including an improved coupling ensuring means which can positively detect whether or not the fitted attitude of the connector housings is perfect.

In accomplishing these and other objects, according to one preferred embodiment of the present invention, there is provided a connector which includes a first connector housing provided with a fitting recess portion, a seal ring having an elastic seal portion and attached to said fitting recess port-on, and a second connector housing so that a forward half portion of the second connector housing is pressed into an inner side of the seal ring for compressive fixing of said elastic seal portion.

The connector further includes a detection switch portion provided in a hollow portion formed within a wall of the elastic seal portion, and composed of a pair of confronting contacts adapted to contact each other for electrical conduction by the compressive fixing of the elastic seal portion, with lead wires of the detection switch portion being led out of the seal ring to provide contact ends, detecting terminals incorporated within the first connector housing so as to be conducted with the contact ends and for leading detection cords out of the connector housing, and also an ensuring means for ensuring fitting attitude of the first and second connector housings, disposed at a position which turns on the detection switch portion only when said first and second connector housings are in a normally fitted attitude.

In the waterproof connector of the present invention having the construction as described above, when the male and female housings are fitted to each other in the normal attitude, the detection switch portion incorporated in the elastic seal portion of the seal ring is turned on in association with the elastic compression thereof, and a detection circuit is formed by conduction in the detection cords outside the housing through the incorporated detecting terminals. In the case of the half-fitting when the fitting amount of the connector housings is insufficient, since the elastic compression in the elastic seal portion at the detection switch portion does not take place, and the off state at said detection switch portion is maintained, the state of the fitted attitude of the connector housings, i.e. completeness or incompleteness of the coupling may be positively detected by the conduction or non-conduction of the detection cords outside the connector housing.

In another embodiment of the present invention, there is also provided a connector which includes a first connector housing having a forward half portion, and a second connector housing provided with a fitting recess portion for coupling therebetween by fitting the forward half portion of the first connector housing into the fitting recess portion of the second connector housing.

The connector is further provided with a connector coupled state ensuring means which includes a detection switch portion of a "rubber switch" type provided in the first connector housing, and composed of a switch means facing a forward edge of a peripheral wall of the fitting recess portion of the second connector housing, with the first connector housing being further incorporated therein with a detecting terminal connected to the detection switch portion and also leading out a detection cord from the first connector housing, and a switch actuating projection provided at the forward edge of the peripheral wall of the fitting recess portion of the second connector housing for turning on the detection switch portion only in a normally coupled state between the first and second connector housings.

In the connector according to the above embodiment, since the connector coupled state ensuring means is so arranged that when the set of connector housings are correctly fitted with each other for assuming the normal attitude, the switch actuating projection for the second connector housing depresses the detection switch portion of the first connector housing for conduction of the detection circuit, the normal coupling may be positively detected by the confirmation of the conduction thereof, while on the contrary, if the connector housings are not coupled with each other sufficiently, the switch actuating projection does not reach said detection switch portion so as to maintain the switch turned off state, and thus, such half-fitting fault may be positively detected by the non-conduction of the detection circuit. Owing to the fact that such confirmation of the detection state becomes possible at a position spaced from the connector housing main body, and simultaneously, the detection switch portion has a "rubber switch" construction, resistance to water is achieved for application to the waterproof connector.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1B:
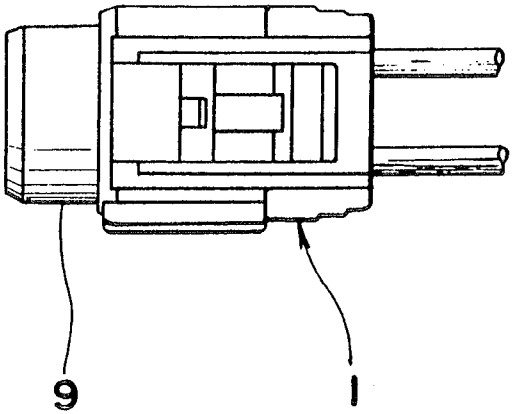
FIGS. 1(A) and 1(B) are top plan views, partly in section, showing constructions of a male connector housing and a female connector housing constituting a waterproof connector according to one preferred embodiment of the present invention.
Figure 2B:
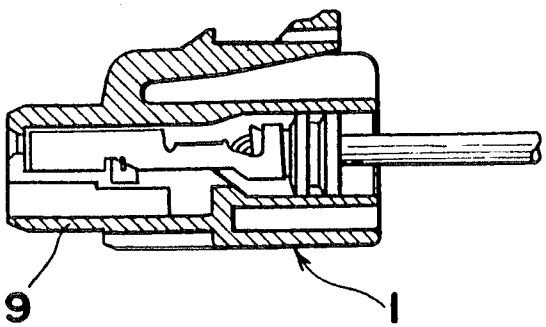
FIGS. 2(A) and 2(B) are respectively side sectional views of the male and female connector housings shown in FIGS. 1(A) and 1(B)

Before the description of the present invention proceeds, it is to be noted that like parts are designated by like reference numerals throughout the accompanying drawings.

Referring now to the drawings, there is shown in FIGS. 1(A) to 4(B), a connector C1 of a waterproof type according to one preferred embodiment of the present invention, which generally includes a female connector housing 1 (referred to as a female housing hereinafter) having female terminals (not particularly shown), and a male connector housing 2 (referred to as a male housing hereinafter) accommodating therein male terminals 3, which housings 1 and 2 are to be coupled with each other in a manner described hereinafter.

Figure 1A:
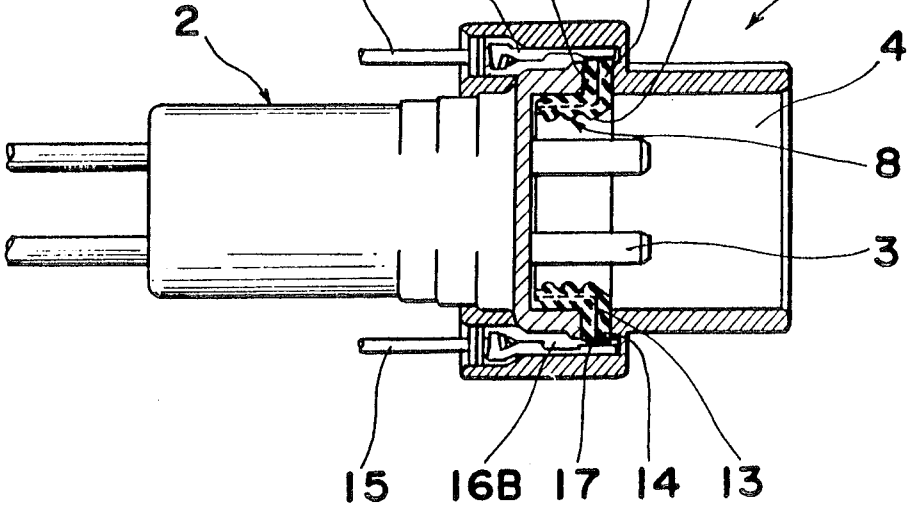
Figure 2A:
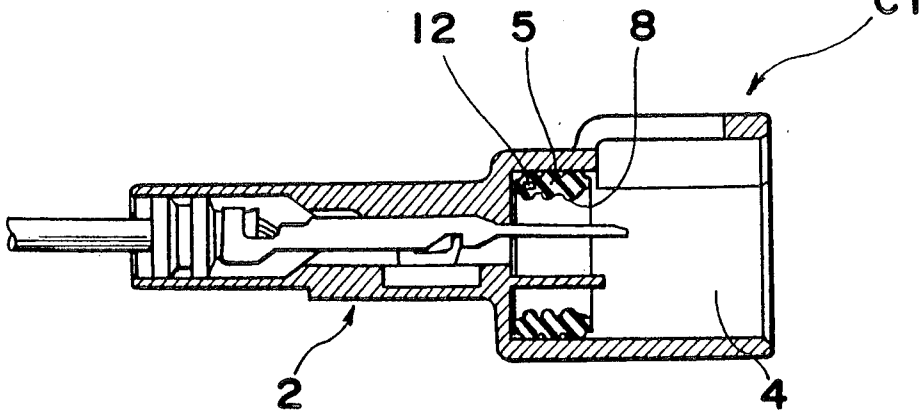
Figure 3B:
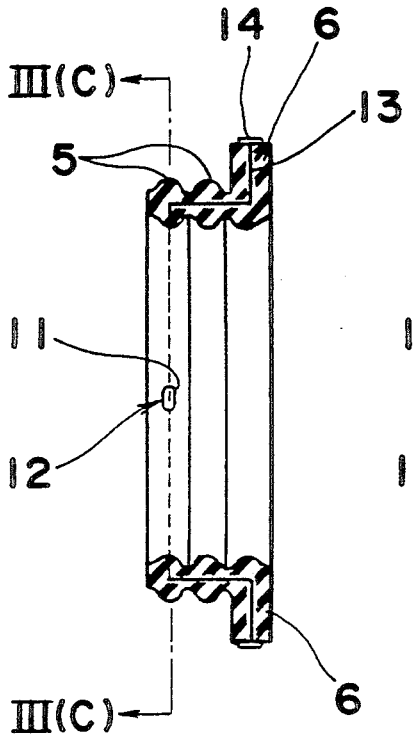
FIG. 3(B) is a cross section at a central portion of the seal ring shown in FIG. 3(A)
Figure 3A:
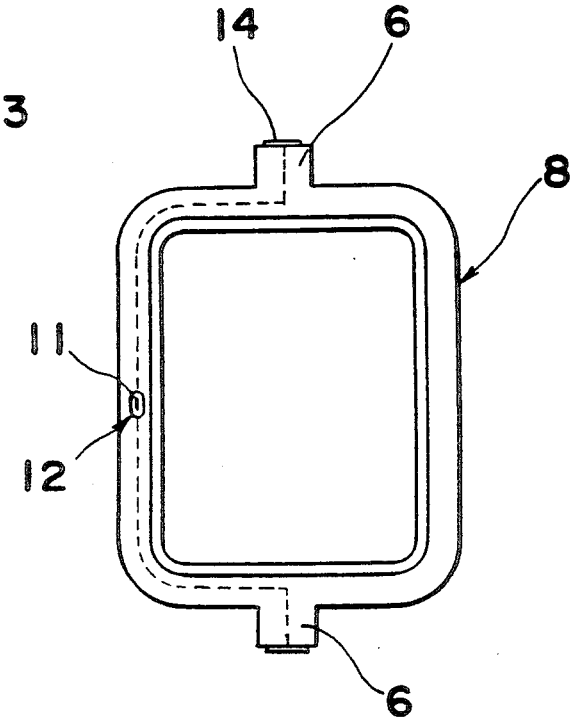
FIG. 3(A) is a front elevational view of a seal ring employed in the connector of FIGS. 1(A) and 1(B)

At a front half portion of the male housing 2 (i.e. at right side in FIG. 1(A)), there is provided a fitting recess portion 4 having a bottom and open at a front portion thereof (i.e. at the right side in FIG. 1(A)), and around a rear inner periphery of said fitting recess portion 4, a seal ring 8 is mounted which is adapted to closely apply a resilient compressible elastic seal portion 5 onto the inner periphery of said fitting recess portion 4, and also to engage a pair of engaging pieces 6 (FIG. 3(A)) projecting outwardly therefrom into corresponding window portions 7 of the fitting recess portion 4. Into the inner side of said seal ring 8, a forward half portion 9 (at the left side in FIG. 1(B)) of the female housing 1 is fitted, thereby to fit the elastic seal portion 5 of the seal ring 8 between said forward half portion 9 and the inner periphery of the fitting recess portion 4, in a compressed state for coupling of the male housing 2 with the female housing 1 in a watertight state.

Figure 3C:
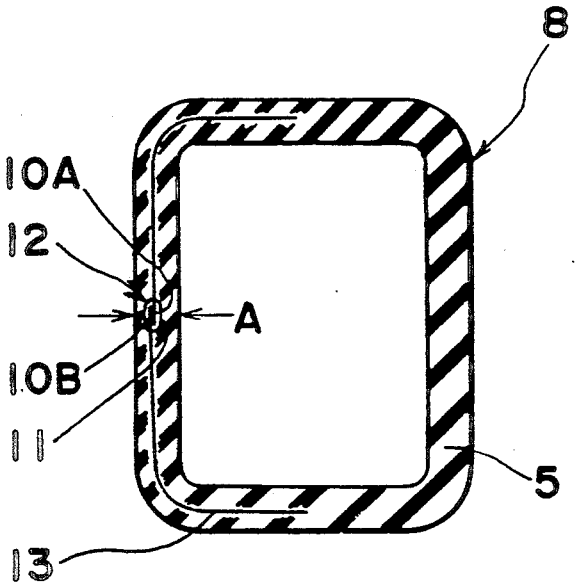
FIG. 3(C) is a cross section taken along the line III(C-)—III(C) in FIG. 3(B)
Figure 3D:
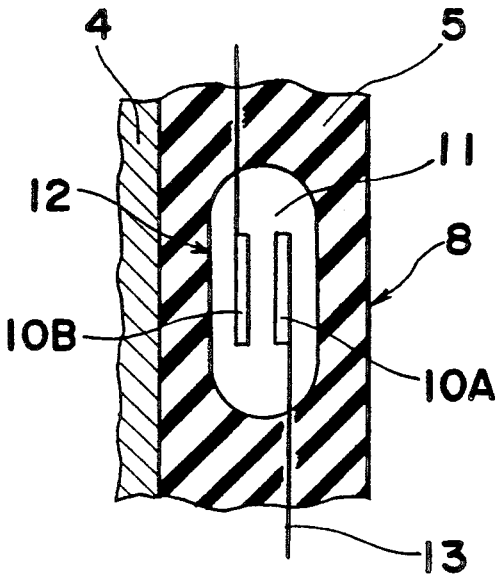
FIG. 3(D) is a fragmentary cross section showing on an enlarged scale, a portion of the seal ring in FIG. 3(C) for explaining construction of a detection switch portion incorporated within a hollow portion in a wall of the seal ring.
Figure 4A:
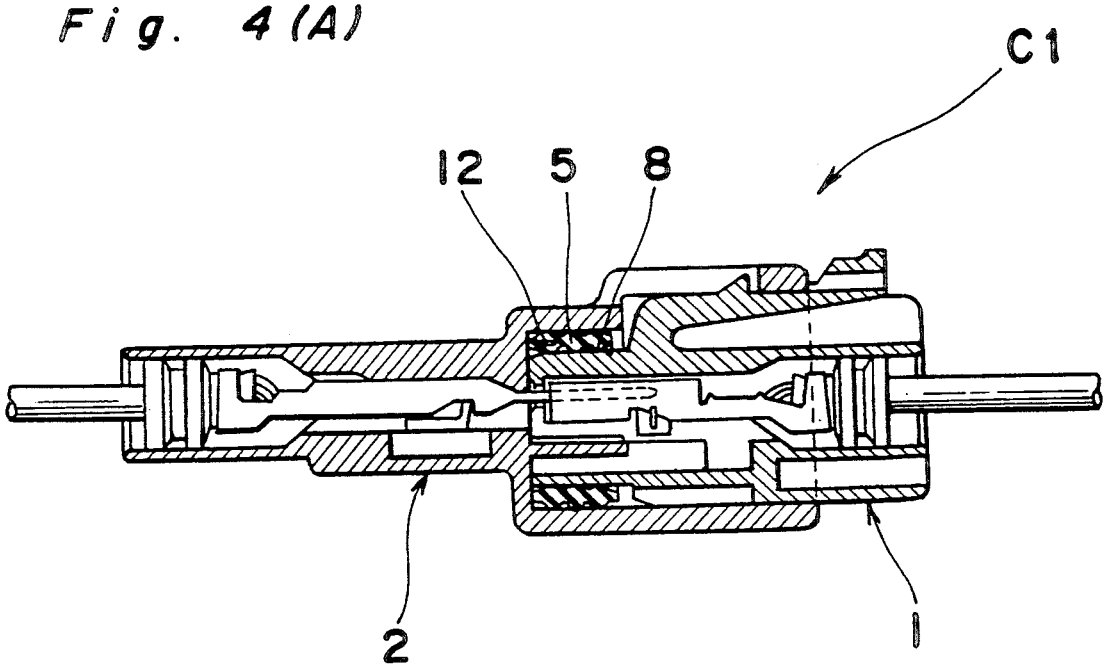
FIG. 4(A) is a side sectional view of the male and female connector housings in FIGS. 2(A) and 2(B) as coupled with each other.
Figure 4B:
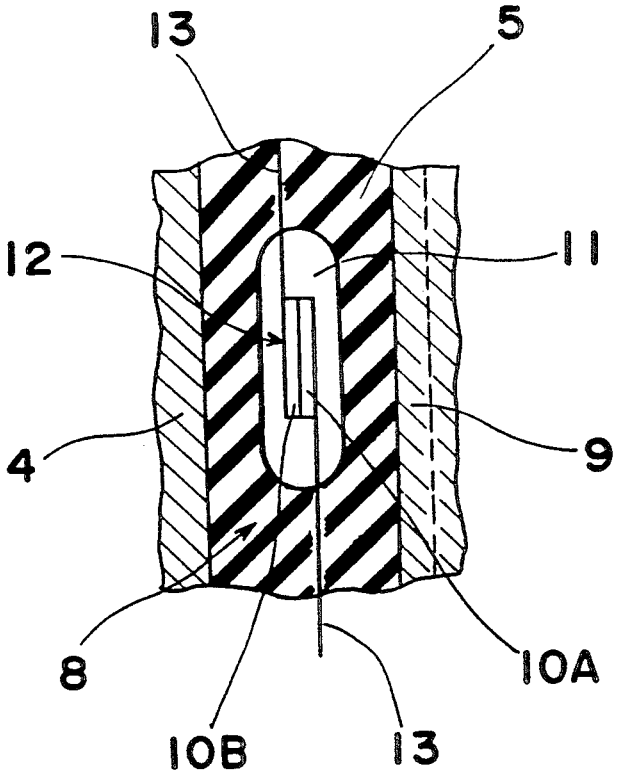
FIG. 4(B) is a view similar to FIG. 3(D) for explaining functioning of the detection switch portion.

Within the wall of the elastic seal portion 5 at the forward edge of the seal ring 8 (at a position close to the bottom of the fitting recess portion 4), a small inner-wall hollow portion 11 (FIG. 3(D)) is provided, in which hollow portion, a detection switch portion 12 composed of a pair of contacts 10A and 10B arranged to confront each other in the compressing direction of the elastic seal portion 5(i.e. in a direction indicated by an arrow A in FIG. 3(C)) is disposed, while lead lines 13 of said contacts 10A and 10B are individually led out of the pair of the engaging pieces 6 through the wall of the seal ring 8 so as to provide contact ends 14 as shown.

In the peripheral wall portion of the male housing 2 at the outer side of said contact ends 14, detecting terminals 16A and 16B are incorporated, with detection leads 15 being led out therefrom towards the outer side of said housing 2 as is most clearly seen in FIG. 1(A). Contact portions 17 of said detecting terminals 16A and 16B contact the contact ends 14 for conduction therebetween, and when the forward half portion 9 of the female housing 1 is inserted into the fitting recess portion 4, with the forward half portion 9 being pressed into the inner side of the elastic seal portion 5 of the seal ring 8, and the elastic seal portion 5 held between said forward half portion 9 in the normally fitted attitude and the fitting recess portion 4 is subjected to elastic compression (FIGS. 4(A) and 4(B)), the inner-wall hollow portion 11 of the detection switch portion 12 is compressed for conduction between the contacts 10A and 10B, while upon withdrawal of said forward half portion 9 from the fitting recess portion 4, the elastic seal portion 5 is elastically restored to the original state, and the inner-wall hollow portion 11 expands for automatic spacing between the contacts 10A and 10B. Thus, an ensuring means for the fitting attitude of the housings 1 and 2 is provided, with the detection switch portion 12 and said detecting terminals 16A and 16B being utilized as essential portions thereof.

It should be noted here that the detection switch portion 12 is provided at the forward end limit portion where the forward half portion 9 of the female housing 1 compresses the elastic seal portion 5 as described earlier only when the female and male housings 1 and 2 are fitted to each other in the normal attitude.

In the connector according to the first embodiment of the present invention as described so far, upon fitting of the female and male housings 1 and 2 in the normal attitude, the detection circuit as described earlier is formed, while in the half or insufficient fitting between said housings where the fitting amount therebetween is not enough, the forward half portion 9 of the female housing 1 does not compress the elastic seal portion 5 at the detection switch portion 12 of the seal ring 8 at the side of the male housing 2, and therefore, there is no conduction between the contacts 10A and 10B so as to continue the off state as shown in FIG. 3(D) for non-conduction of the detection circuit, and thus, it is possible to positively detect whether or not the fitting between the female and male housings 1 and 2 is normal by the conduction or non-conduction of the detection circuit.

As is seen from the foregoing description, since the connector according to the present invention can positively detect and ensure whether or not the connector housings are properly coupled with each other, it has an effect for improving quality through prevention of faulty coupling between the connector housings.

Referring further to FIGS. 5(A) to 7(B), there is shown another connector C2 according to a second embodiment of the present invention.

The connector C2 also includes a female housing 21 having a female terminal 23, and a male housing 22 accommodating therein a male terminal 24, which are to be coupled with each other for connection therebetween. An outer peripheral portion of a terminal accommodating portion 25 of the female housing 21 is formed into a cylindrical seal ring attaching portion 26, around which a seal ring 27 is mounted. Meanwhile, the male housing 22 is formed with a cylindrical recess portion 28 at its right side as shown in FIG. 5(A). This recess portion 28 of the male housing 22 is fitted over the seal ring 27 on the seal ring attaching portion 26 of the female housing 21 upon insertion of the male housing 22, whereby the outer periphery of the seal ring 27 is caused to contact the inner periphery of the fitting recess portion 28 under pressure, with the inner periphery of said seal ring 27 being pressed against the surface of the seal ring attaching portion 26, and thus, the female housing 21 and the male housing 22 are coupled with each other through the fitted portion adapted to be waterproof.

Figure 5B:
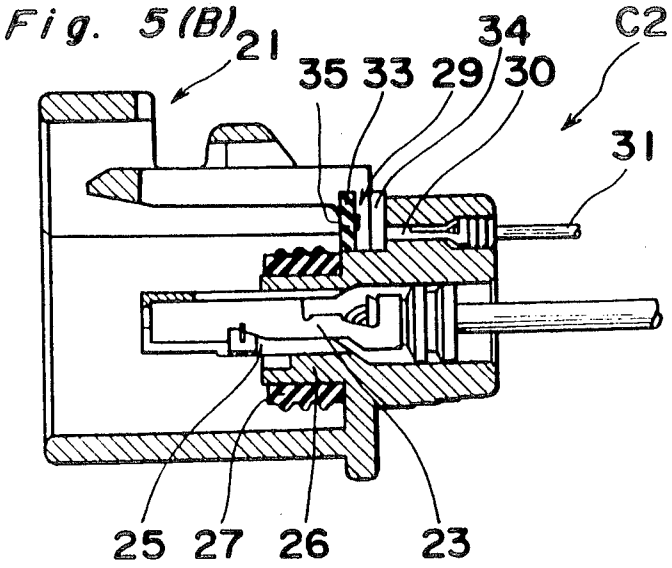
FIGS. 5(A) and 5(B) are respectively side sectional views of male and female connector housings constituting a connector according to a second embodiment of the present invention.
Figure 5A:
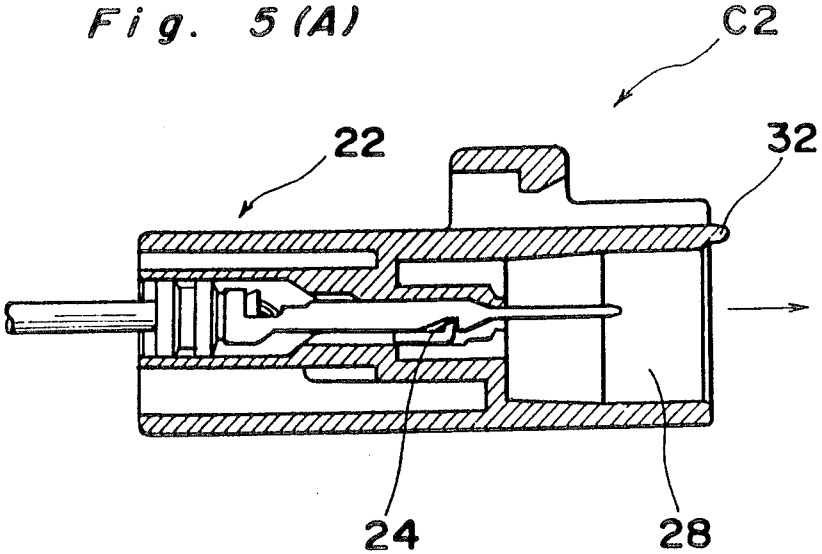
Figure 6:
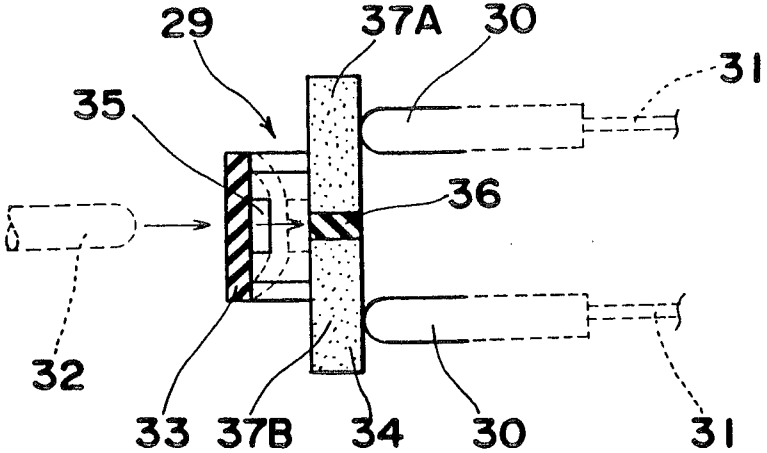
FIG. 6 is a schematic diagram for explaining functions of a detection switch portion in the connector of FIGS. 5(A) and 5(B), and FIGS. 7(A) and 7(B) are respectively side sectional views of the male and female connector housings of FIGS. 5(A) and 5(B) as coupled with each other for explaining functioning of the connector for the second embodiment of the present invention.

At a rear edge portion of the seal ring attaching portion 26 for the female housing 21, there is provided a detection switch portion 29 disposed to confront a forward edge of a peripheral wall of the fitting recess portion 28 of the mating male housing 22, while a pair of detecting terminals 30 are incorporated behind said detection switch portion 29 (i.e. towards the rear side of the female housing 21), with detection cords 31 connected to said detecting terminals 30 being led out of the housing 21 (FIGS. 5(B) and 6).

On the other hand, at the forward edge of the peripheral wall of the fitting recess portion 28 of the male housing 22, a switch actuating projection 32 facing said detection switch portion 29 is provided, and when the housings 21 and 22 are fitted to each other in the normal attitude, said switch actuating projection 32 depresses the detection switch portion 29 to turn on the detection circuit formed by the detection cords 31, thereby to constitute an ensuring means of coupling attitude for detecting the normal fitting between the female and male housings 21 and 22.

More specifically, as shown in FIG. 6, the detection switch portion 29 includes a movable substrate 33, for example, of a silicon rubber and a stationary substrate 34 of an electrically conductive rubber which are disposed to be opposed to each other, and a contact portion 35 of a metallic conductor provided at an inner central portion of said movable substrate 33 to face said stationary substrate 34, which is in the form of a single plate as divided into two electrically conductive portions 37A and 37B by an insulative portion 36, while forward ends of the pair of detecting terminals 30 as incorporated in the female housing 21 are held in contact with the reverse faces of the conductive portions 37A and 37B for connection therewith to constitute said detection switch portion 29.

Thus, when the switch actuating projection 32 at the side of the male housing 22 depresses the movable substrate 33, said substrate 33 is elastically deformed as shown by dotted lines in FIG. 6, and the contact portion 35 thereof is brought into contact with the conductive portion 37A and 37B, thereby to form a detection circuit across the pair of the detecting terminals 30 for actuating display means such as a detection lamp (not shown) or the like provided on the detection cords 31. In other words, in the detection switch portion 29 of a water resistant rubber switch construction, the movable substrate 33 of the water resistant rubber material and the stationary substrate 34 are provided to confront each other, so that, by the displacement due to depression of the movable substrate 33, the detection circuit is formed between the divided conductive portions 37A and 37B of the stationary substrate 34.

Figure 7A:
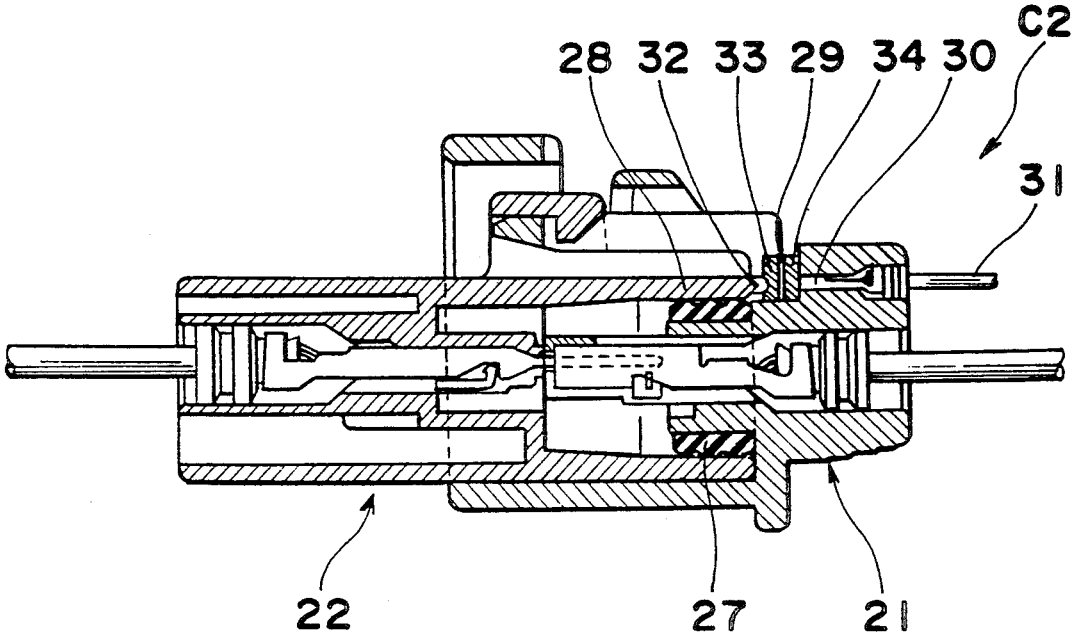

In the waterproof connector C2 according to the second embodiment of the present invention as described so far, when the female and male housings 21 and 22 are fitted to each other in the normal attitude (FIG. 7(A)), the switch actuating projection 32 of the male housing 22 pushes in the movable substrate 33 of the detection switch portion 29 of the female hosing 21 to turn on the switch, and therefore, through the conduction of the detection circuit by the turning on of the switch, normal fitting and coupling between the female and male housings 21 and 22 may be positively detected.

Figure 7B:
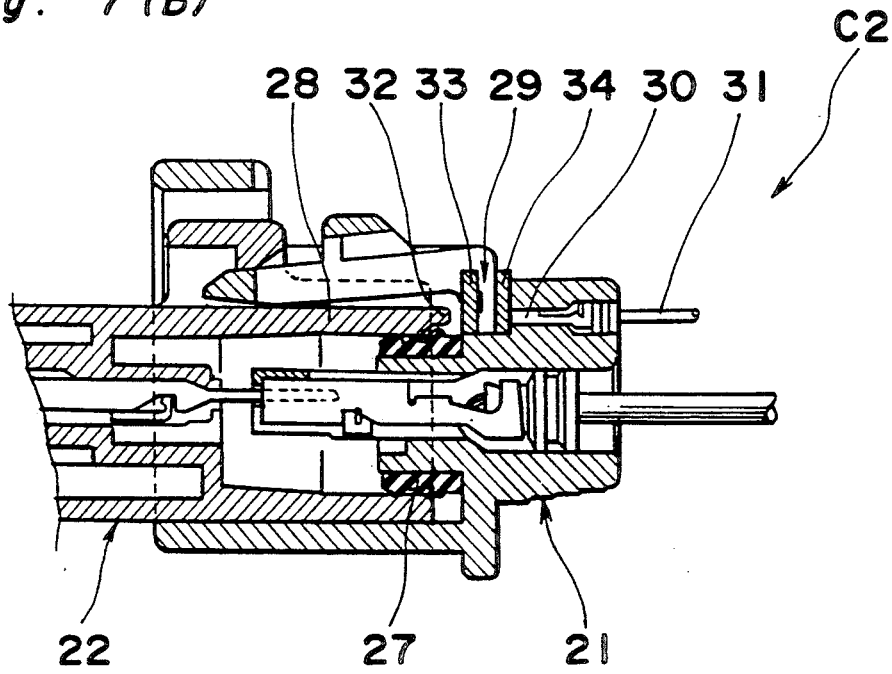

On the contrary, in the half-fitting in which the fitting amount between the housings 21 and 22 are insufficient (FIG. 7(B)) since the switch actuating projection 32 does not reach the movable substrate 33 of the switch portion 29, with the state of "switch off" being maintained, the faulty coupling between the housings 21 and 22 are detected by the non-conduction of the detection circuit.

Accordingly, the connector of the present invention is most suitable as a connector for an automobile to be mounted in a small space, and since no restriction is present in the posture for mounting the connector, the connector of the present invention may be effectively utilized through elimination of disadvantages in the conventional connectors of this kind, while it may also be applied to a waterproof connector which requires resistance to water.

As is clear from the foregoing description, the connector of the present invention provided with the connector coupled state ensuring means as described above, is capable of ensuring whether or not the coupled state of the housings is good at the position remote from the connector main body, while it has the resistance against water, without any particular restriction in the coupled attitude of the connector housings. Therefore, the connector according to the present invention has a wide field of application for use as the connector for the automobile, and also, as the waterproof connector, and thus, quality improvement may be achieved by preventing faulty coupling of the connector on the whole.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. A connector comprising:

a first connector housing having a fitting recess portion;

a seal ring having an elastic seal portion and being attached to said fitting recess portion, said seal portion having a cavity provided in a wall thereof;

a second connector housing including a forward half portion adapted to be retained within said fitting recess portion so as to press against an inner circumference of said seal ring;

a detection switch disposed within said cavity in said wall of said elastic seal portion, and including a pair of confronting contacts adapted to electrically contact each other when said second connector is coupled to said first connector causing the wall of said elastic seal portion to be compressed thereby indicating that said first and second connector housing have been completely coupled to one another.

2. A connector as claimed in claim 1, wherein said first connector housing is a male connector housing and said second connector housing is a female connector housing to be coupled with each other.

3. A connector, comprising:

a first connector housing having a forward half portion;

a second connector housing including a tubular wall defining a fitting recess portion for coupling said first and second connector housings by fitting said forward half portion of said first connector housing into said fitting recess portion of said second connector housing; and a connector coupled state ensuring means for ensuring that said first and second connector housing are completely coupled to one another, said ensuring means including a detection switch provided in said first connector housing and facing a forward edge of said tubular wall of said second connector housing; and a switch actuating projection provided at the forward edge of said tubular wall of said second connector housing for turning on said detection switch only in a normally coupled state between said first and second connector housings.

4. A connector as claimed in claim 3, wherein said first connector housing is a male connector housing and said second connector housing is a female connector housing to be coupled with each other.

* * * * *